US006381423B1

(12) United States Patent
Eom

(10) Patent No.: US 6,381,423 B1
(45) Date of Patent: Apr. 30, 2002

(54) PRINTER AND METHOD FOR ADJUSTING GAP BETWEEN TRANSFER ROLLER AND FUSING ROLLER THEREOF

(75) Inventor: Yoon-seop Eom, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/672,970

(22) Filed: Sep. 29, 2000

(30) Foreign Application Priority Data

Feb. 21, 2000 (KR) ..... 00-8180

(51) Int. Cl.[7] ..... G03G 15/00; G03G 15/20

(52) U.S. Cl. ..... 399/45; 371/265.04; 399/308; 399/339

(58) Field of Search ..... 399/45, 308, 339; 271/265.04

(56) References Cited

U.S. PATENT DOCUMENTS 5,435,543 A * 7/1995 Lehmann ..... 271/265.04 X
5,655,176 A * 8/1997 Inoue et al. ..... 399/45
5,966,559 A * 10/1999 May et al. ..... 399/45
6,000,693 A * 12/1999 Tranquilla ..... 271/265.04 X
6,002,891 A * 12/1999 Shin ..... 399/45
6,111,594 A * 8/2000 Jeong ..... 399/45 X

FOREIGN PATENT DOCUMENTS

JP 6-19341 * 1/1994
JP 8-254907 * 10/1996
JP 9-34281 * 2/1997

* cited by examiner

*Primary Examiner*—Fred L. Braun
(74) *Attorney, Agent, or Firm*—Robert E. Bushnell, Esq.

(57) ABSTRACT

A method and apparatus that measures a thickness of a sheet of recording medium prior to image formation. Once measured, the transfer roller and the fusing roller may be set apart at an optimum distance to achieve optimum image quality for any thickness of a sheet of recording medium. Employed is a simple, non-contact thickness sensing apparatus and method. Inductive electromotive force or intensity of light reflected off a movable metallic roller are employed to determine the thickness of the sheet of recording medium. The result is excellent image quality transferred from a photoreceptor web and onto a sheet of recording medium, regardless of the thickness of the sheet of recording medium.

14 Claims, 4 Drawing Sheets

PRINTER AND METHOD FOR ADJUSTING GAP BETWEEN TRANSFER ROLLER AND FUSING ROLLER THEREOF

CLAIM OF PRIORITY

This application makes reference to, incorporates the same herein, and claims all benefits accruing under 35 U.S.C. §119 from the inventor's application PRINTER AND METHOD OF CONTROLLING THE GAP OF FUSING ROLLER filed with the Korean Industrial Property Office on Feb. 21, 2000 and there duly assigned Serial No. 8180/2000.

BACKGROUND OF THE INVENTION

1. Field of the Invention

The present invention relates to a printer in which the gap between the transfer roller and the fusing roller is adjusted according to the thickness of paper inserted therebetween, and a fusing roller gap adjusting method thereof.

2. Description of the Related Art

In printing apparatuses, a transfer roller transfers an image from a photoreceptor web onto a sheet of recording medium. A fusing roller forms a nip with the transfer roller and is often diametrically opposite the photoreceptor web as a sheet of recording medium passes between the transfer roller and the fusing roller. If the sheet of recording medium is thin or of standard thickness, the image successfully transfers onto the sheet of recording medium. However, if the sheet of recording medium is unusually thick, the image transfer is poor as the gap is too small between the transfer roller and the fusing roller.

What is needed is a printing apparatus that can adjust the size of the gap between the transfer roller and the fusing roller automatically based on the thickness of each sheet of recording medium so that unusually thick sheets, as well as thin or standard thickness sheets, can obtain a good image quality.

SUMMARY OF THE INVENTION

It is therefore an object of the present invention to provide an image forming apparatus where the gap between the fusing roller and the transfer roller can automatically be adjusted based on the thickness of the recording medium.

It is also an object to provide an image forming apparatus that can print high quality images on thin or standard thickness recording medium as well as on unusually thick sheets of recording medium.

It is further an object to provide an image forming apparatus that can measure the thickness of the sheet of recording medium prior to when said sheet of recording medium reaches the transfer roller and the fusing roller.

It is yet another object to provide an apparatus that can measure the thickness of a sheet of recording medium prior to when said sheet of recording medium reaches the transfer roller/fusing roller combination.

It is still another object to provide a mechanism for adjusting the gap between the transfer roller and the fusing roller by moving the fusing roller towards or away from the transfer roller prior to printing on a sheet of recording medium.

It is further an object of the present invention to provide a method for measuring a thickness of a sheet of recording medium, and based on said measurement, adjust the gap between the transfer roller and the fusing roller to provide optimum image quality on said sheet of recording medium.

Accordingly, to achieve the above object, there is provided a printer comprising a printing portion for forming a toner image on a circulating photoreceptor web, a transfer roller rotating in contact with the photoreceptor web so that the toner image formed on the photoreceptor web is transferred, a fusing roller installed to face the transfer roller, conveying rollers installed along a paper conveying path from a paper feeding portion to the transfer roller and the fusing roller, to be capable of being released corresponding to the thickness of the paper passing between the transfer roller and the fusing roller, a fusing roller gap adjusting portion for adjusting a separation distance of the fusing roller with respect to the transfer roller, a displacement measuring sensor installed to face the conveying roller for measuring a vertical displacement of the conveying roller varying according to the thickness of the paper passing the conveying roller, and a paper thickness calculating portion for calculating the thickness of the paper passing the conveying roller from the vertical displacement information output from the displacement measuring sensor and controlling the fusing roller gap adjusting portion so that a separation distance set to correspond to the calculated paper thickness is maintained between the transfer roller and the fusing roller.

It is preferred in the present invention that a surface of the conveying roller is formed of metal, the displacement measuring sensor is an electromagnetic induction sensor for forming an electromagnetic field with respect to the conveying roller and outputting an electric signal induced corresponding to the displacement of the conveying roller, and the paper thickness calculating portion calculates the thickness of the paper passing the conveying roller from the electric signal output from the electromagnetic induction sensor corresponding to the vertical displacement of the conveying roller.

Also, to achieve the above object, there is provided a fusing roller gap adjusting method of a printer comprising the steps of (A) calculating a reference position value of the conveying roller from the signal output from the displacement measuring sensor before the paper enters the conveying roller, (B) calculating the thickness of the paper by subtracting the reference position value from the vertical displacement value calculated from the value output from the displacement measuring sensor corresponding to the vertical displacement of the conveying roller when the paper passes the conveying roller, and (C) adjusting the position of the fusing roller so that a gap is set to correspond to the calculated paper thickness value is maintained between the transfer roller and the fusing roller.

It is preferred in the present invention that, in step (A), the reference position value is determined by averaging displacement values calculated from the values output from the displacement measuring sensor while rotating the conveying roller at least one time.

Also, it is preferred in the present invention that, in step (A), the maximum value of displacement values calculated from the values output from the displacement measuring sensor while rotating the conveying roller at least one time is determined as the reference position value.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

FIG: 3 is a view illustrating a displacement measuring sensor according to a preferred embodiment of the present invention.

DETAILED DESCRIPTION OF THE INVENTION

Figure 1:
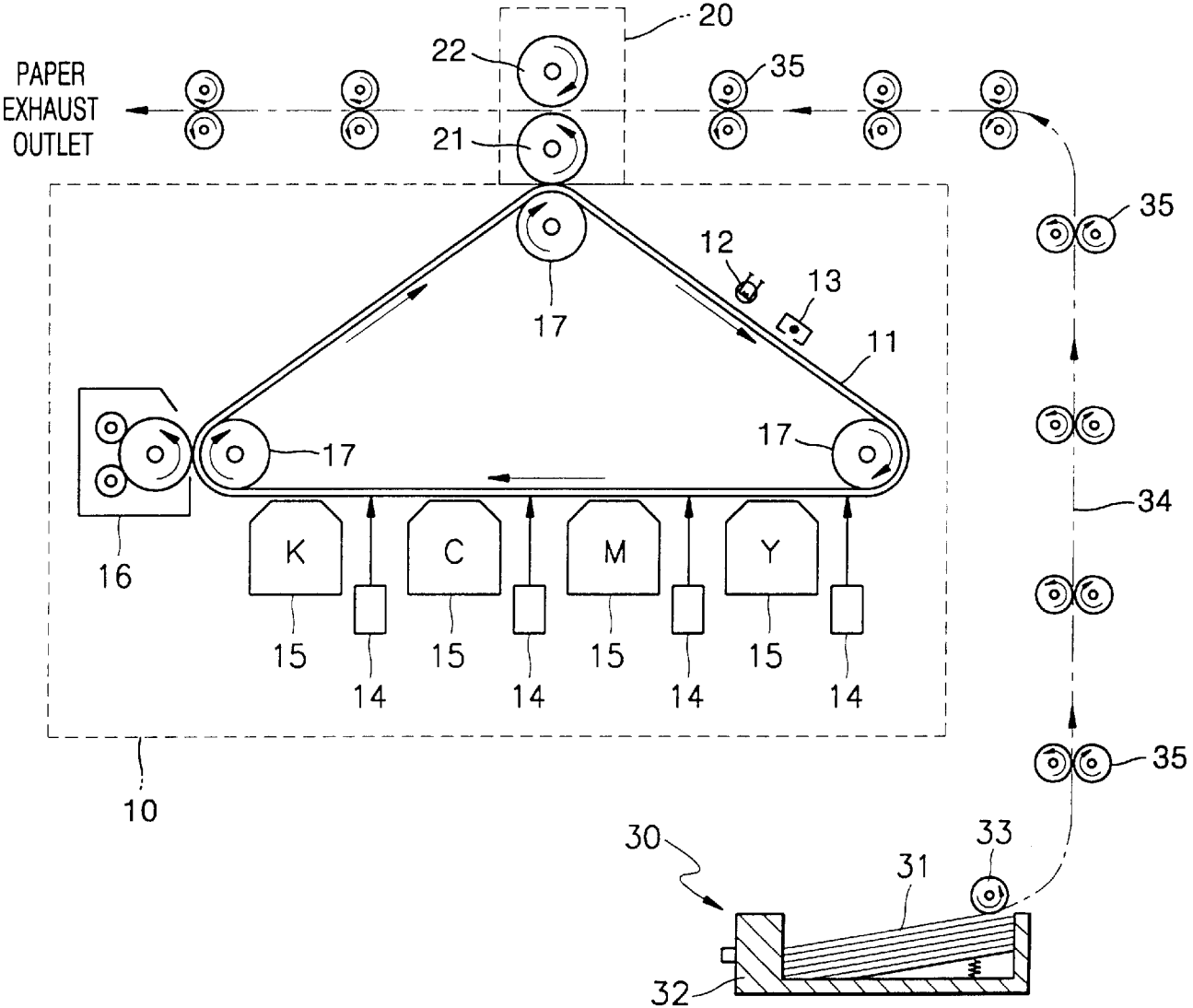
FIG. 1 (Background Art)
FIG. 1 is a view illustrating a printer.

FIG. 1 is a view illustrating a printer. Referring to the drawing, the printer includes a printing portion 10, a transferring portion 20 and a paper feeding portion 3 0. The printing portion 10 includes a photoreceptor web 11, a discharger 12, a charger 13, a plurality of optical scanning units 14, a plurality of developing units 15, and a drying unit 16. The discharger 12 erases an electrostatic latent image formed on a photoreceptor web 11 by emitting light to the photoreceptor web 11 circulating around a plurality of rollers 17. The charger 13 charges the photoreceptor web 11 to a predetermined electric potential so that a new electrostatic latent image is written on the photoreceptor web 11. The optical scanning units 14 selectively emit light corresponding to an image to form an electrostatic latent image on the photoreceptor web 11. The developing units 15 develop the electrostatic latent image by supplying developer to the photoreceptor web 11. The drying unit 16 is applied when a mixture of toner and liquid carrier component is used as developer. The drying unit 16 dries and removes the liquid carrier which remains on the photoreceptor web 11.

The transferring portion 20 includes a transfer roller 21 which rotates in contact with the photoreceptor web 11 and a fusing roller 22 installed to face the transfer roller 21, so that the toner image formed on the photoreceptor web 11 is transferred to a sheet of paper 31 inserted between the transfer roller 21 and the fusing roller 22. The paper feeding portion 30 includes a paper feeding cassette 32, a pickup roller 33 for picking up the paper 31 contained in the paper feeding cassette 32 and a plurality of conveying rollers 35 installed along a paper conveying path 34 from the pickup roller 33 to the transferring portion 20 to convey the picked up paper.

In the operation of the printer having the above structure, each of the optical scanning units 14 emits light corresponding to image information to the photoreceptor web 11 circulating at a constant speed. The developing units 15 develop the electrostatic latent image formed by the optical scanning units 14. After passing the drying unit 16, the toner image formed on the photoreceptor web 11 is transferred by the transfer roller 21 to the paper 31 which is supplied from the paper feeding portion 30. Since the above printing process is continuously performed, while the existing toner image on the photoreceptor web 11 is transferred on the paper 31, a new subsequent image is formed on the photoreceptor web 11 by the optical scanning unit 14 and the developing unit 15.

In earlier image forming apparatuses, the transfer roller 21 and the fusing roller 22 are installed such that the relative positions thereof is maintained to be constant while rotating. As a result, when a thick paper is supplied and not smoothly inserted between the transfer roller 21 and the fusing roller 22, the rotation of the transfer roller 21 is hindered due to its thickness. That is, as the gap between the transfer roller 21 and the fusing roller 22 cannot be adjusted corresponding to the thickness of the paper 31, the paper 31 proceeding by the conveying rollers 35 along the paper conveying path 34 momentarily stops at the entry in the gap between the transfer roller 21 and the fusing roller 22. In this case, the paper 31 momentarily restrains the rotation of the transfer roller 21 and accordingly the speed of the photoreceptor web 11 circulating in contact with the transfer roller 21 is momentarily lowered. Such a change in the rotation speed of the transfer roller 21 and the circulation speed of photoreceptor web 11 causes an image forming error. That is, while the optical scanning units 14 scan information about the next image onto the photoreceptor web 11 in tune with a set speed of the photoreceptor web 11, the circulation speed of the photoreceptor web 11 is momentarily lowered due to the above disorder of conveying the paper 31 inserted between the transfer roller 21 and the fusing roller 22. Here, since the interval between image lines currently formed on the photoreceptor web 11 is narrowed, the image forming error is generated. The above phenomenon becomes more serious as the thickness of the paper 31 increases.

Figure 2:
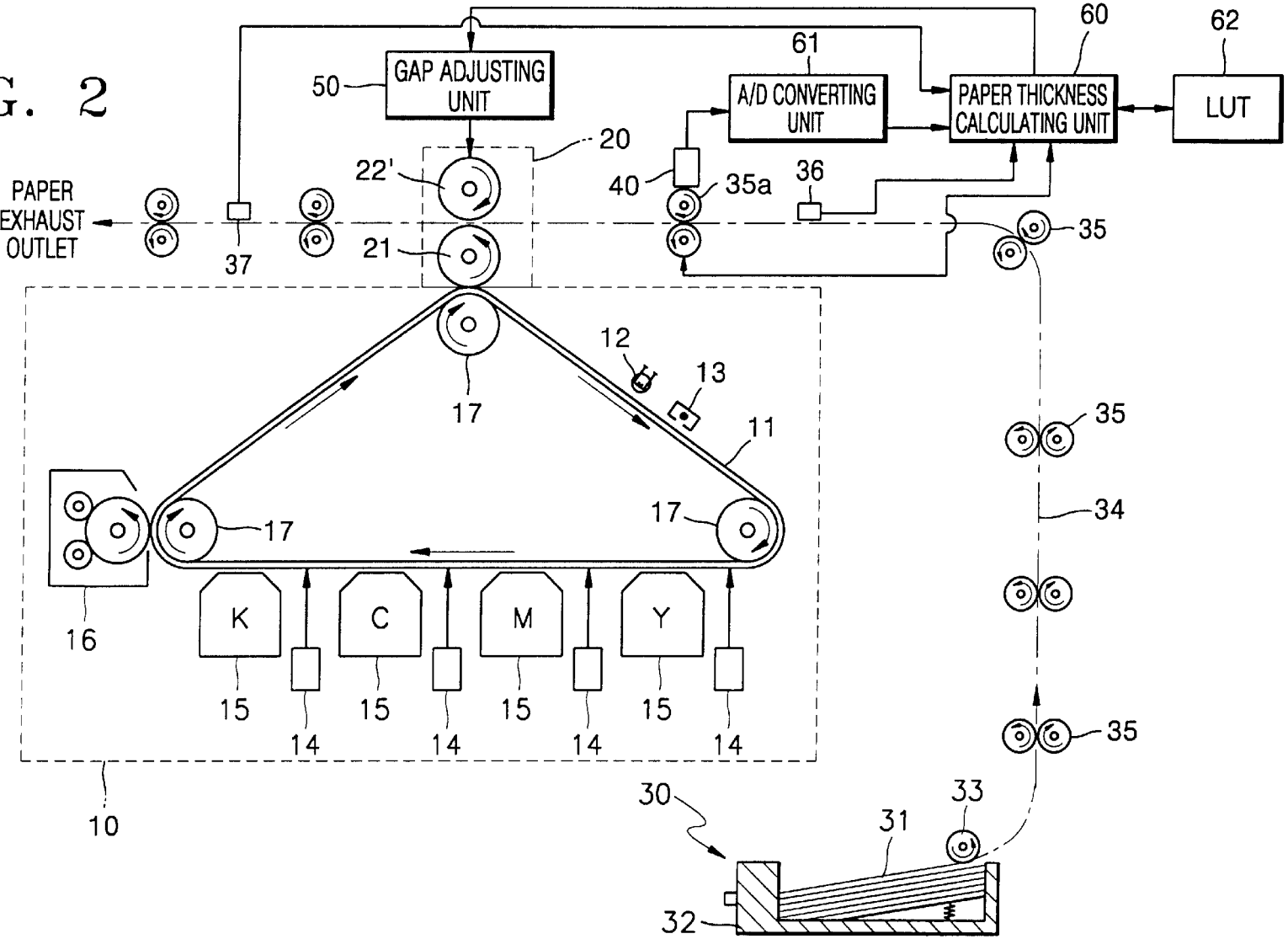
FIG. 2 is a view illustrating a printer according to the present invention.

In FIG. 2, the same reference numerals as those in FIG. 1 denote the same elements having the same functions. Referring to FIG. 2, the printer includes the printing portion 10, the transfer portion 20, the paper feeding portion 30, a displacement measuring sensor 40, a fusing roller gap adjusting unit 50 for adjusting a gap between a fusing roller and a transfer roller, and a paper thickness calculating unit 60. Reference numerals 36 and 37 denote sensors indicating arrival of paper proceeding along the paper conveying path 34 from their respective positions. The printing portion 10 includes the photoreceptor web 11, the discharger 12, the charger 13, the optical scanning units 14, the developing units 15 and the drying unit 16. The transfer portion 20 includes the transfer roller 21 rotating in contact with the photoreceptor web 11 and a fusing roller 22' installed to face the transfer roller 11 and capable of adjusting a relative gap between the transfer roller 21 and the fusing roller 22' under the control of the fusing roller gap adjusting unit 50. For example, the fusing roller 22' has a shaft which can move up and down perpendicularly with respect to the transfer roller 21 by being driven by the fusing roller gap adjusting unit 50. The fusing roller gap adjusting unit 50 adjusts the position of the fusing roller 22' so that a gap according to control information output from the paper thickness calculating unit 60 can be maintained between the transfer roller 21 and the fusing roller 22'.

The displacement measuring sensor 40 outputs a signal corresponding to the thickness of the paper 31 on the paper conveying path 34 from the paper feeding portion 30 to the transferring portion 20. Preferably, the displacement measuring sensor 40 can detect a vertical displacement of the conveying roller **35*a* selected from the conveying rollers 35 installed along the paper conveying path 34. For example, a variable resistor (not shown) for determining a value of resistance corresponding to a vertical displacement, by being directly engaged with the vertical displacement of the conveying roller 35*a*, is coupled to the conveying rolls 35*a*, and a circuit for outputting a value of voltage corresponding to the vertical displacement is provided. Alternatively, a circuit for determining a value of electrostatic capacity corresponding to the vertical displacement of the conveying roller 35*a* provided. Alternatively, light is emitted to the conveying roller 35*a* from a fixed position and the change in the amount of light reflected by the conveying roller 35*a* corresponding to the vertical displacement of the conveying roller 35*a* is measured by a photodetector (not shown). Preferably, the displacement measuring sensor 40 has a structure so that the conveying roller 35***a* can be easily disassembled when the conveying roller 35*a* is to be replaced, and that a paper thickness measuring error is less generated even when foreign material separated from the paper 31 contaminates the conveying roller 35*a*.

According to a preferred embodiment of the present invention, an electromagnetic induction sensor satisfying the above conditions is used as the displacement measuring sensor 40. The electromagnetic induction sensor is installed to be separated a predetermined distance from the conveying roller 35*a* selected to detect the thickness of paper and forms an electromagnetic field with respect to the conveying roller 35*a* and outputs an electric signal which is induced in response to the displacement of the conveying roller 35*a*. To apply such an electromagnetic induction sensor, the surface of the conveying roller 35*a* selected for detection of the thickness of paper is formed of metal.

Figure 3:
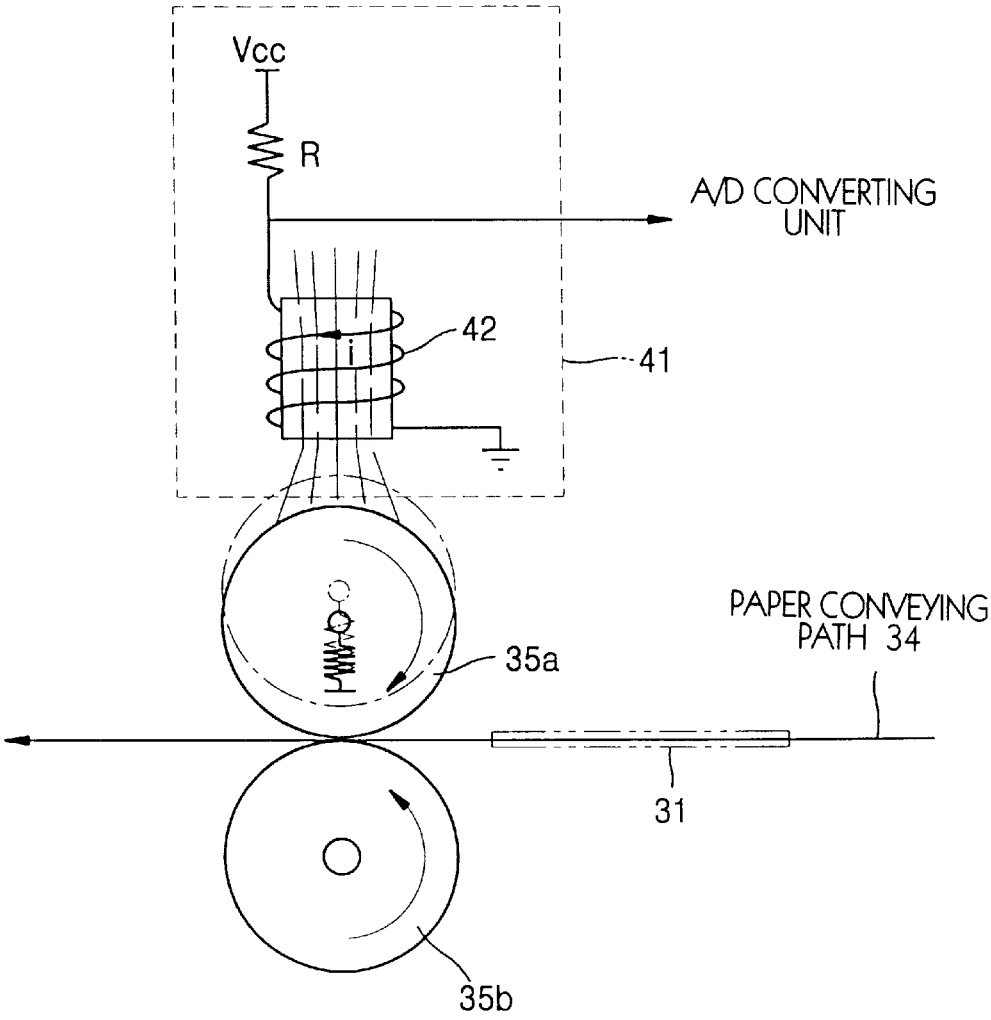

FIG. 3 schematically illustrates the configuration of the electromagnetic induction sensor. Referring to the drawing, in an electromagnetic induction sensor 41, a current conduction path is formed through a coil 42 wound around a ferrite material via a fixed resistor R from a voltage source Vcc. In the operation thereof, a magnetic field is formed by current flowing though the coil 42 with respect to the conveying roller 35*a* which is installed to be released from a lower roller 35*b* rotatably installed at a fixed position corresponding to the thickness of the inserted paper. When the conveying roller 35*a* is vertically lifted in a process of passing the paper 31 between the lower roller 35*b* and the conveying roller 35*a*, the value of current flowing through the coil 42 varies due to an inductive electromotive force. Thus, the voltage output between a resistance device R and the coil 42 varies in response to the vertical displacement of the conveying roller 35*a*. The electromagnetic induction sensor 41 can detect information on the paper thickness corresponding to the displacement of the conveying roller 35*a* by a non-contact type. Thus, it is easy to install and the accuracy in detecting the vertical displacement of the conveying roller 35*a* is not much affected by the contamination of the conveying roller 35*a* by the foreign material separated from the paper 31. An analog/digital (A/D) converting unit 61 converts an analog signal output from the displacement measuring sensor 40 to a digital signal and outputs the converted signal to the paper thickness calculating unit 60. The paper thickness calculating unit 60 calculates the thickness of the paper passing the conveying roller 35*a* from the information on vertical displacement output from the displacement measuring sensor 40. Also, the paper thickness calculating unit 60 controls the fusing roller gap adjusting unit 50 so that the separated distance set corresponding to the calculated thickness of the paper can be maintained between the transfer roller 21 and the fusing roller 22 while the paper passes therebetween. The vertical displacement value of the conveying roller 35*a* corresponding to the signal input through the A/D converting unit 61 from the displacement measuring sensor 40 is recorded on a lookup table (LUT) 62. Thus, the paper thickness calculating unit 60 calculates the thickness of the paper 31 by searching for the vertical displacement value of the conveying roller 35*a* corresponding to the signal input through the A/D converting unit 61 from the LUT 62. Also, the paper thickness calculating unit 60 controls the fusing roller gap adjusting unit 50 so that the gap set corresponding to the calculated thickness of the paper can be maintained between the transfer roller 21 and the fusing roller 22. The gap between the transfer roller 21 and the fusing roller 22 is set such that an image can be transferred from the transfer roller 21 without slippage and the disturbance of rotation of the transfer roller 21 in a process of conveying the paper 31 having the calculated thickness. The gap corresponding to the thickness of the paper is appropriately determined according to the material of the surfaces and the rotation speeds of the transfer roller 21 and the fusing roller 22.

Figure 4:
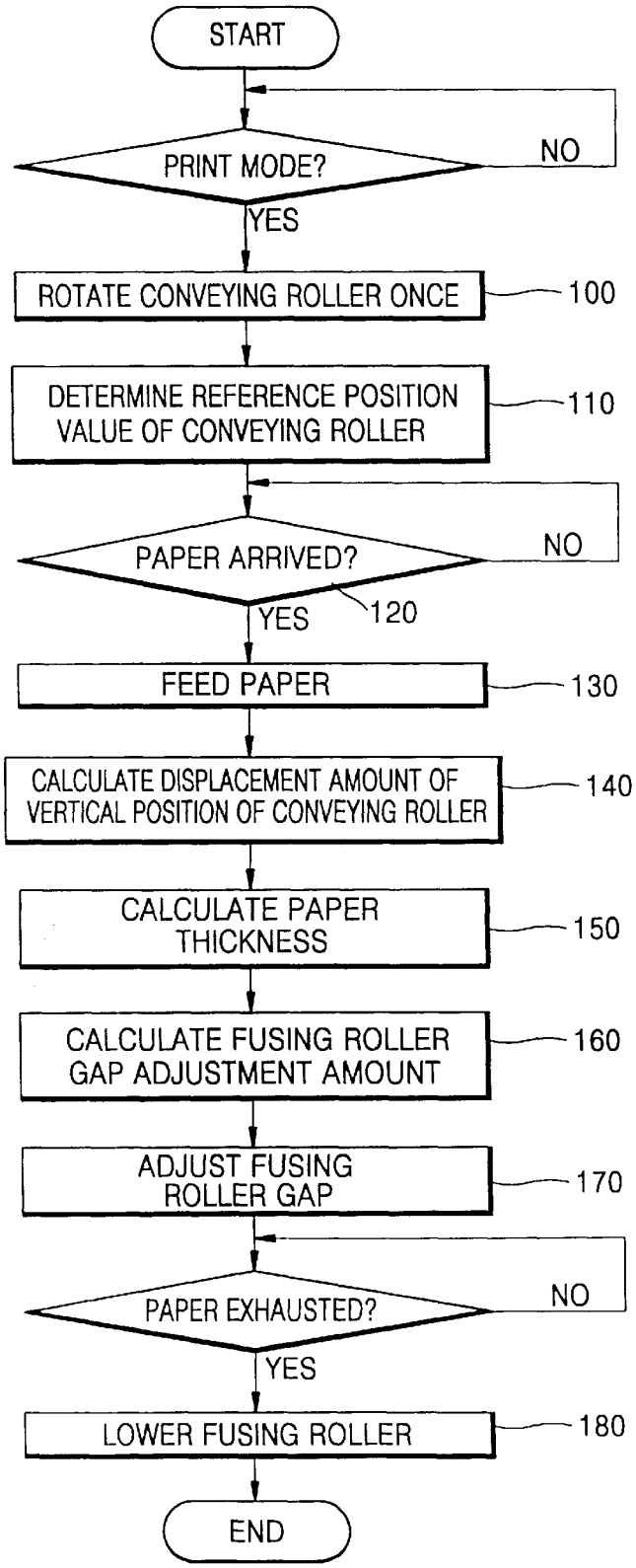
FIG. 4 is a flow chart for illustrating the process of adjusting the gap between the transfer roller and the fusing roller of the printer according to the present invention.

The process of adjusting the gap between the transfer roller 21 and the fusing roller 22, with improved accuracy in measuring the paper thickness, considering that a reference position of the conveying roller 35*a* prior to passage of the paper changes due to the foreign material separated from the paper 31 adhering to the surface of the conveying roller 35*a*, is described with reference to FIG. 4. First, in a print mode, as a preparation step prior to starting a print job, a value of the reference position of the conveying roller 35*a* is calculated from signals output from the displacement measuring sensor 40 in the step before the paper arrives at a conveying roller 35*a* which is selected to measure the thickness of the paper. Preferably, while the conveying roller 35*a* is rotated at least one time (step 100), a reference position value is determined by averaging position values calculated from the value output from the displacement measuring sensor 40 (step 10). Alternatively, the maximum value of the position values calculated from the values output from the displacement measuring sensor 40 while rotating the conveying roller 35*a* at least one time is determined as the reference position value. When the reference position value is determined from the position values sampled during the rotation of the conveying roller 35*a*, an appropriate initial reference value can be determined for the case in which foreign material adheres to the outer circumferential surface of the conveying roller 35*a* or the outer diameter of the conveying roller 35*a* changes due to abrasion. Then, it is determined by the paper passage confirmation sensor 36 provided before the selected conveying roller 35*a* whether the paper 31 has arrived (step 120). When the paper 31 is determined to arrive in step 120, the conveying roller 35*a* rotates to pass the paper 31 (step 130). While the paper 31 passes the conveying roller 35*a*, a vertical position value of the conveying roller 35*a* is calculated from the value output from the displacement measuring sensor 40 corresponding to the vertical movement of the conveying roller 35*a* (step 140). In this step, the vertical displacement value of the conveying roller 35*a* is calculated by averaging the position values calculated from the values output from the displacement measuring sensor 40 while the conveying roller 35*a* rotates at least one time. Alternatively, the maximum value of the position values calculated from the values output from the displacement measuring sensor 40 while the conveying roller 35*a* rotates at least one time is calculated as the vertical displacement value of the conveying roller 35*a*. Next, the thickness of the paper 31 is calculated by subtracting the reference position value calculated in step 110 from the calculated vertical position value (step 150). After obtaining the paper thickness, the gap between the transfer roller 21 and the fusing roller 22 is calculated according to the calculated paper thickness (step 160). When the gap of the fusing roller 22 is calculated in step 160, the vertical position of the fusing roller 22 is adjusted accordingly (step 170). When a paper passage signal is received from the paper passage confirmation sensor 37 provided between the transfer roller 21 and a paper exhaust outlet, the fusing roller 22 is lowered to the initial position (step 180). Although the case in which the photoreceptor web 11 is used as a photoreceptor medium is described, the present invention can be applied to a case in which a photoreceptor drum is used as the photoreceptor medium.

As described above, according to the printer and the fusing roller gap adjusting method thereof according to the present invention, the gap between the transfer roller and the fusing roller is adjusted according to the thickness of the paper inserted therebetween. Thus, when the paper passes the transfer roller, an obstacle to rotation of the photoreceptor web can be reduced, thus preventing an image forming error.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. An image forming apparatus, comprising:

a printing portion for forming a toner image on a circulating photoreceptor web;

a transfer roller rotating in contact with the photoreceptor web so that the toner image formed on the photoreceptor web is transferred to a sheet of recording medium;

a fusing roller installed to face the transfer roller;

a pair of conveying rollers installed along a recording medium conveying path between a recording medium feeding portion and said transfer roller and the fusing roller pair, one of said pair of conveying rollers being a movable, metallic conveying roller capable of being displaced in a direction orthogonal to said conveying path, a distance moved by said movable conveying roller corresponding to the thickness of the sheet of recording medium passing between said pair of conveying rollers;

a fusing roller gap adjusting portion for adjusting a separation distance of the fusing roller with respect to the transfer roller based on an amount of displacement of said movable conveying roller;

a non-contact displacement measuring sensor installed to face the movable conveying roller for measuring a vertical displacement of the movable conveying roller varying according to the thickness of the sheet of recording medium passing the pair of conveying rollers; and a recording medium thickness calculating portion for calculating the thickness of the recording medium passing the pair of conveying rollers from the vertical displacement information output from the displacement measuring sensor and controlling the fusing roller gap adjusting portion so that a separation distance set to correspond to the calculated recording medium thickness is maintained between the transfer roller and the fusing roller, the displacement measuring sensor being an electromagnetic induction sensor for forming an electromagnetic field of a strength commensurate with the distance the movable conveying roller is displaced, said non-contact sensor outputting an electric signal whose strength corresponds to the displacement of the movable conveying roller, and the recording medium thickness calculating portion calculates the thickness of the recording medium passing the pair of conveying rollers from the electric signal output from the electromagnetic induction sensor corresponding to the vertical displacement of the movable conveying roller.

2. The image forming apparatus of claim 1, the recording medium thickness calculating portion calculates the thickness of the recording medium from a lookup table where a value of the thickness of recording medium corresponding to the electric signal is recorded.

3. A image forming apparatus that can print sharp images on varying thicknesses of recording medium, comprising:

a sheet feeding tray having a pickup roller;

an upper and a lower conveying roller wherein sheets of recording medium slide therethrough, said upper roller being metallic and having an axle that can be vertically displaced by a distance commensurate with a thickness of a sheet of recording medium that slides therebetween;

a non-contact measuring sensor that puts out an electrical signal proportional to said vertical displacement of said upper conveying roller while never forming any contact with said upper conveying roller when a sheet of recording medium passes between said upper and lower conveying rollers;

a transfer roller disposed between a rotating photoreceptor web and a fusing roller wherein sheets of recording medium pass between said transfer roller and said fusing roller after passing between said upper and lower conveying rollers; and a gap adjusting unit that moves said fusing roller towards and away from said transfer roller based on said electrical signal, allowing an image to be printed onto a sheet of recording medium of varying thickness without causing an image forming error.

4. The image forming apparatus of claim 3, further comprising an analog to digital converter for converting said electrical signal to digital format.

5. The image forming apparatus of claim 4, further comprising a recording medium thickness calculating unit that determines how far said fusing roller must be moved from said transfer roller based on said digital signal and sends this information on to said gap adjusting unit.

6. The image forming apparatus of claim 5, wherein said recording medium thickness calculating unit comprises a look up table in a memory that determines the size of said gap between said fusing roller and said transfer roller based on said digital signal delivered from said analog to digital converter.

7. The image forming apparatus of claim 3, said measuring sensor is an electromagnetic induction sensor combined with a resistor that produces a voltage proportional to the distance said upper conveying roller is displaced when a sheet of recording medium is fed between said upper conveying roller and said lower conveying roller.

8. The image forming apparatus of claim 3, wherein said measuring sensor is a light source that illuminates said upper conveying roller and a detector measures light reflected from said upper conveying roller when said upper conveying roller is displaced by said sheet of recording medium and said detector converts the reflected light signal into said electrical signal.

9. A fusing roller gap adjusting method of a image forming apparatus comprising a printing portion for forming a toner image on a circulating photoreceptor web, a transfer roller rotating in contact with the photoreceptor web so that the toner image formed on the photoreceptor web is transferred to a sheet of recording medium, a fusing roller installed to face the transfer roller, a pair of conveying rollers installed along a recording medium conveying path between a recording medium feeding portion and the transfer roller and the fusing roller, one of said pair of conveying rollers being a movable, metallic and capable of being displaced corresponding to a thickness of a sheet of recording medium passing between the pair of conveying rollers, a fusing roller gap adjusting portion for adjusting a separation distance of the fusing roller with respect to the transfer roller based on an amount of displacement of said movable conveying roller, and a recording medium thickness calculating portion for calculating the thickness of the recording medium passing the pair of conveying rollers from the vertical displacement information output from the displacement measuring sensor and controlling the fusing roller gap adjusting portion so that a separation distance set to correspond to the calculated recording medium thickness is maintained between the transfer roller and the fusing roller, the method comprising the steps of:

(A) calculating a reference position value of said movable conveying roller from a signal output from a non-contact displacement sensor measuring said displacement of said movable conveying roller before a sheet of recording medium is fed between said pair of conveying rollers;

(B) calculating the thickness of the recording medium by subtracting the reference position value from the vertical displacement value calculated from the value output from the non-contact displacement measuring sensor corresponding to a vertical displacement of the movable conveying roller when said sheet of recording medium passes between said pair of conveying rollers; and (C) adjusting the position of the fusing roller so that a gap set to correspond to the calculated recording medium thickness value is maintained between the transfer roller and the fusing roller.

10. The method of claim 9, in step (A), the reference position value is determined by averaging displacement values calculated from the values output from the displacement measuring sensor while rotating the pair of conveying rollers at least one time.

11. The method of claim 9, in step (A), the maximum value of displacement values being calculated from the values output from the displacement measuring sensor while rotating the pair of conveying rollers at least one time is determined as the reference position value.

12. A method for automatically adjusting a gap between a transfer roller and a fusing roller based on a thickness of a sheet of recording medium in an image forming apparatus, said method comprising the steps of:

feeding said sheet between an upper metallic and a lower conveying rollers causing said upper conveying roller to be displaced a distance proportional to said thickness of said sheet of recording medium;

producing an electrical signal proportional to said displacement of said upper conveying roller by an sensor that measures an inductive electromotive force based on a proximity of said metallic upper conveying roller with said sensor, said sensor never making any form of contact with said metallic upper conveying roller;

determining how far from said transfer roller said fusing roller must be displaced based on said electrical signal;

displacing said fusing roller said distance from said transfer roller;

conveying said sheet of recording medium between said transfer roller and said fusing roller wherein an image is affixed to said sheet of recording medium; and discharging said sheet of recording medium containing said image from said image forming apparatus.

13. The method of claim 12, wherein said step of determining how far from said transfer roller said fusing roller must be displaced further comprises the steps of:

converting said electrical signal from analog to digital; and consulting a look-up table in memory that provides for each digital signal a one-to-one correspondence of displacement distance said fusing roller must be displaced from said transfer roller based on said digital signal.

14. The method of claim 12, wherein said step of producing an electrical signal proportional to said displacement of said upper conveying roller is accomplished by a direct current voltage source, a resistor in series with a coil wrapped around a magnetic material disposed near said upper conveying roller.

* * * * *